US006095382A

United States Patent [19]

Gross

[11] Patent Number: 6,095,382

[45] Date of Patent: Aug. 1, 2000

[54] CONTAINER AND CLOSURE WITH DISPENSING VALVE AND SEPARATE RELEASABLE INTERNAL SHIPPING SEAL

[75] Inventor: Richard A. Gross, Oconomowoc, Wis.

[73] Assignee: AptarGroup, Inc., Crystal Lake, Ill.

[21] Appl. No.: 09/157,706

[22] Filed: Sep. 21, 1998

[51] Int. Cl.[7] ..... B67D 3/00

[52] U.S. Cl. ..... 222/520; 222/493; 222/494; 222/520; 222/521; 222/525; 220/254; 215/271

[58] Field of Search ..... 222/494, 520, 222/521, 525, 493; 215/271; 220/254

[56] References Cited

U.S. PATENT DOCUMENTS

| | | |
|---|---|---|
| 1,989,714 | 2/1935 | Statham . |
| 1,996,156 | 4/1935 | Janssen . |
| 2,679,954 | 6/1954 | Barnes . |
| 2,942,762 | 6/1960 | Fahr . |
| 2,998,902 | 9/1961 | Thomas et al. . |
| 3,067,787 | 12/1962 | Salk . |
| 3,123,259 | 3/1964 | Musel et al. . |
| 3,149,755 | 9/1964 | Porter et al. . |
| 3,204,836 | 9/1965 | Joffe . |
| 3,207,375 | 9/1965 | Bereziat et al. . |
| 3,221,952 | 12/1965 | De See . |
| 3,260,423 | 7/1966 | Fillmore et al. . |
| 3,669,323 | 6/1972 | Harker et al. . |
| 3,887,116 | 6/1975 | Ishikawa et al. . |
| 4,269,330 | 5/1981 | Johnson . |
| 4,474,314 | 10/1984 | Roggenburg, Jr . |
| 4,506,809 | 3/1985 | Corsette . |
| 4,561,570 | 12/1985 | Zulauf et al. . |
| 4,728,006 | 3/1988 | Drobish et al. . |
| 4,749,108 | 6/1988 | Dornbusch et al. . |
| 4,807,786 | 2/1989 | Gueret . |
| 4,817,831 | 4/1989 | Theisen . |
| 4,941,598 | 7/1990 | Lambelet, Jr. . |
| 4,969,581 | 11/1990 | Seifert et al. . |
| 4,991,745 | 2/1991 | Brown . |
| 5,033,647 | 7/1991 | Smith et al. . |
| 5,033,655 | 7/1991 | Brown . |
| 5,115,950 | 5/1992 | Rohr . |
| 5,139,182 | 8/1992 | Appla . |
| 5,161,718 | 11/1992 | Gueret . |
| 5,213,236 | 5/1993 | Brown et al. . |
| 5,271,531 | 12/1993 | Rohr et al. . |
| 5,325,999 | 7/1994 | Gueret . |
| 5,339,995 | 8/1994 | Brown et al. . |
| 5,377,877 | 1/1995 | Brown et al. . |
| 5,409,144 | 4/1995 | Brown . |
| 5,439,143 | 8/1995 | Brown et al. . |
| 5,680,969 | 10/1997 | Gross . |
| 5,692,651 | 12/1997 | Fuchs . |

FOREIGN PATENT DOCUMENTS

| | | |
|---|---|---|
| 160336 | 11/1985 | European Pat. Off. . |
| 253495 | 1/1988 | European Pat. Off. . |
| 296103 | 12/1988 | European Pat. Off. . |
| 1474620 | 5/1977 | United Kingdom . |

*Primary Examiner*—Henry J. Recla
*Assistant Examiner*—Timothy L. Maust
*Attorney, Agent, or Firm*—Rockey, Milnamow & Katz, Ltd.

[57] ABSTRACT

A dispensing system is provided for a container having an opening to the interior. The container has a sealable seat around the opening and a thread. A closure is disposed on the container. The closure defines a thread that is threadingly engaged with the container thread for accommodating movement of the closure between a lowered position and an elevated position. The closure defines a dispensing passage for establishing communication between the container opening and the exterior of the closure. The closure includes a dispensing valve disposed in the dispensing passage for opening to dispense fluid therethrough and for closing to occlude flow. The closure includes an occlusion member inwardly of the valve in the dispensing passage to sealingly engage the container seat and prevent flow from the container opening into the dispensing passage below the valve when the closure is in the lowered position and to permit flow into the dispensing passage when the closure is in the elevated position.

18 Claims, 7 Drawing Sheets

CONTAINER AND CLOSURE WITH DISPENSING VALVE AND SEPARATE RELEASABLE INTERNAL SHIPPING SEAL

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

This invention relates to a container and closure system. The invention is particularly suitable for use with a squeeze-type container which can dispense product through a valve which opens when the container is squeezed and which automatically closes when the squeezing pressure is released.

BACKGROUND OF THE INVENTION AND TECHNICAL PROBLEMS POSED BY THE PRIOR ART

A variety of packages, including dispensing packages or containers, have been developed for personal care products such as shampoo, lotions, etc., as well as for other fluid materials. One type of closure for these kinds of containers typically has a flexible, self-closing, slit-type dispensing valve mounted over the container opening. The valve has a slit or slits which define a normally closed orifice that opens to permit fluid flow therethrough in response to increased pressure within the container when the container is squeezed. The valve automatically closes to shut off fluid flow therethrough upon removal of the increased pressure.

Closure designs have been proposed which incorporate such valves, and examples are illustrated in the U.S. Pat. No. 5,680,969. The closure disclosed in that patent has the advantage of not requiring a conventional, removable lid or hinged lid. Further, the closure includes a sealing system which includes a plug between the valve and a discharge aperture in the body of the closure below the valve. The closure can be manipulated to close the sealing system to prevent the valve from being exposed to any of the hydraulic pressures in the container until the container is ready for use. The container remains securely sealed below the valve during shipping and when it is packed for travel. Because the sealing system is internal and is not visible to the user, once the user has initially unsealed the container to permit operation of the valve, the user will be more likely to subsequently leave the container in the unsealed condition for more convenient dispensing by action of the self-closing valve alone.

While a package consisting of a container and the closure disclosed in the U.S. Pat. No. 5,680,969 functions exceptionally well and has desirable advantages, in some applications it would be desirable to provide a dispensing system with fewer components to reduce the cost of the package and simplify assembly of the complete package. Such an alternate dispensing system should preferably not require a lid but nevertheless function to protect the valve and to effect complete sealing of the container contents when desired.

Such an alternate dispensing system should be able to effectively seal off the valve from contact with the container contents during shipping or when otherwise desired.

Additionally, it would be beneficial if the dispensing system components could be provided with an improved system for readily accommodating the assembly of the components during manufacture.

Also, it would be desirable if such an improved dispensing system could be provided with a design that would accommodate efficient, high quality, large volume manufacturing techniques with a reduced product reject rate.

Further, such an improved dispensing system should advantageously accommodate its use with a variety of container shapes.

The present invention provides an improved dispensing system which can accommodate designs having the above-discussed benefits and features.

BRIEF SUMMARY OF THE INVENTION

According to the present invention, a dispensing system is provided for a container which has an opening to the container interior. The system provides a leak-tight seal which is especially useful when the container is shipped or packed by a user for travel.

The invention is especially suitable for use with a dispensing valve because a closure seal is disposed between the valve and the container contents. This prevents the valve from being exposed to any of the hydraulic pressures in the container until the container is ready for use. The container remains securely sealed during shipping and when it is packed for travel. Because the sealing system is internal and not visible to the user, the user, once having initially unsealed the container to permit operation of the valve, will be more likely to subsequently leave the container in the unsealed condition for more convenient dispensing by action of the self-closing valve alone.

The dispensing system of the present invention includes a container. The container has an opening, a sealable seat around the opening, and a thread.

The dispensing system includes a closure which is adapted to be disposed on the container. The closure defines a thread that is threadingly engaged with the container thread for accommodating movement of the closure between a lowered position and an elevated position. The closure defines a dispensing passage for establishing communication between the container opening and the exterior of the closure. The closure also includes a dispensing valve disposed in the dispensing passage for opening to dispense fluid therethrough and for closing to occlude flow. An occlusion member is located inwardly of the valve in the dispensing passage. The occlusion member sealingly engages the container sealable seat to prevent flow from the container opening into the dispensing passage below the valve when the closure is in the lowered position. The occlusion member permits flow into the dispensing passage when the closure is in the elevated position.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

FIG. 8 shows portions broken away to illustrate interior details;

DESCRIPTION OF THE PREFERRED EMBODIMENT

Figure 1:
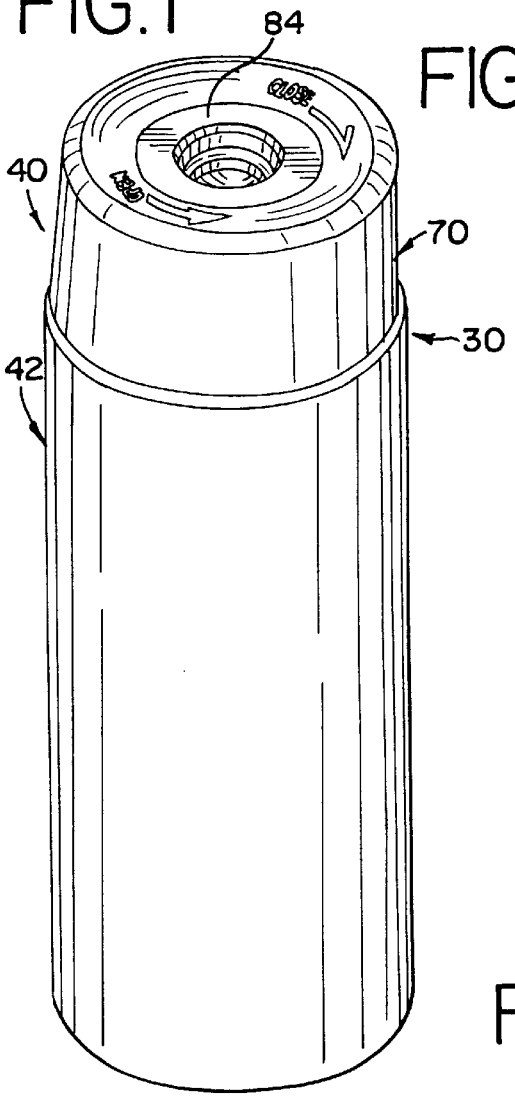
FIG. 1 is a perspective view of a first embodiment of a container and closure dispensing system of the present invention shown with the closure in the lowered, closed position on the container.

While this invention is susceptible of embodiment in many different forms, this specification and the accompanying drawings disclose only one specific form as an example of the invention. The invention is not intended to be limited to the embodiment so described, and the scope of the invention will be pointed out in the appended claims.

For ease of description, the dispensing system of this invention is described in various positions, and terms such as upper, lower, horizontal, etc., are used with reference to these positions. It will be understood, however, that the system components may be manufactured and stored in orientations other than the ones described.

With reference to the figures, the dispensing system of the present invention is incorporated in a package represented generally in many of those figures by the reference numeral 30. The system or package 30 includes a closure 40 which is adapted to be disposed on a container 42 (FIGS. 2, 11, and 12) which has a mouth or opening 41 formed by a neck 43. The neck 43 has a circular cross-sectional configuration with an exterior thread 46, preferably a helical male thread. The interior of the neck 43 defines a sealable seat 48 (FIGS. 9, 11, and 12) which is preferably a vertical, annular, cylindrical surface extending downwardly from an inwardly tapered surface 47.

Figure 2:
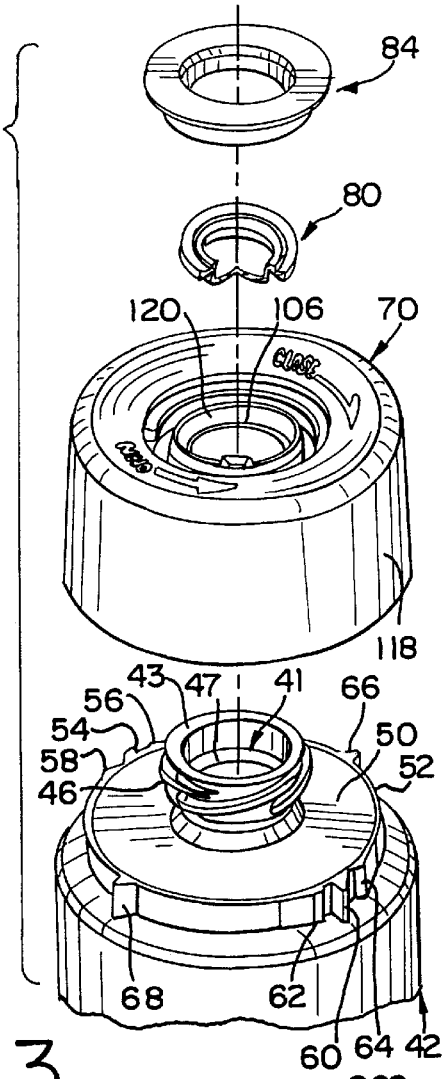
FIG. 2 is an exploded, perspective, fragmentary view of the closure and top of the container shown in FIG. 1, and FIG. 2 also shows portions cut away to illustrate interior detail.
Figure 11:
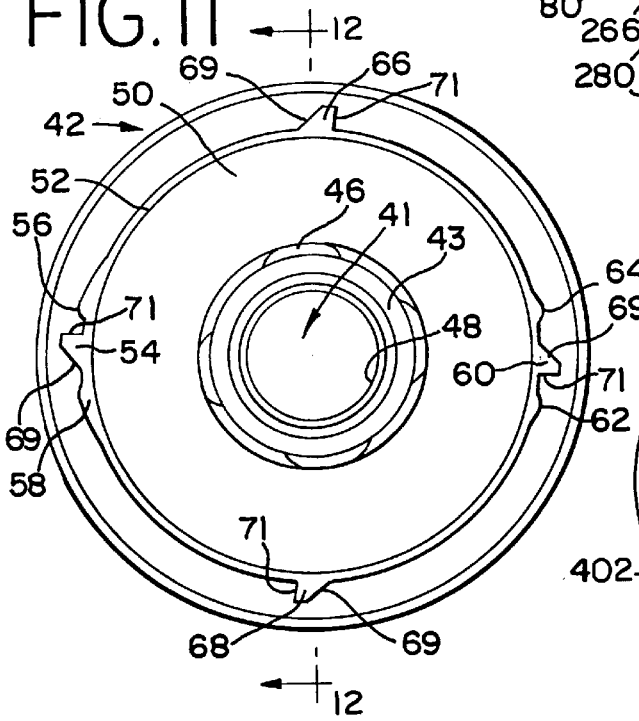
FIG. 11 is a top plan view of the container shown in FIG. 2.
Figure 12:
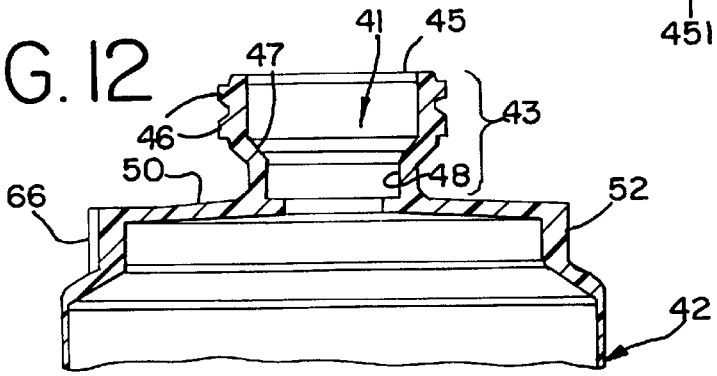
FIG. 12 is a fragmentary, cross-sectional view taken generally along the plane 12—12 in FIG. 11.

The body of the container 42 is generally cylindrical, but may have another cross-sectional configuration, such as an oval cross-sectional shape, for example. The container 42 has an upper end wall 50 (FIGS. 2 and 12) from which the neck 43 extends. The periphery of the end wall 50 optionally defines a circular shoulder 52 (FIGS. 2 and 12). Projecting outwardly from the shoulder 52 is an optional feature—at least one stop member or lug 54 (FIGS. 2 and 11).

Also, in the illustrated preferred embodiment, there may optionally be provided one rib or bump 56 adjacent one side of the stop member 54. Preferably, there is another rib or bump 58 adjacent the other side of the stop member 54.

Also, in the preferred embodiment, the shoulder 52 includes another stop member 60 about 180° from the stop member 54. Preferably, a rib or bump 62 projects from the shoulder 52 on one side of the stop member 60, and a rib or bump 64 projects from the shoulder 52 on the other side of the stop member 60. Thus, each stop member 54 and 60 lies between two spaced-apart ribs—56, 58 and 62, 64, respectively.

Further, in the preferred embodiment, there are two additional stop members 66 and 68 projecting outwardly from the shoulder 52. The stop members 66 and 68 are 180° apart, and each is located 90° from the other two stop members 54 and 60. Thus, the four stop members 54, 60, 66, and 68 are equally spaced at 90° increments around the circumference of the shoulder 52.

Each stop member 54, 60, 66, and 68 has a rear angled surface 69 and a front engaging surface 71. Each front engaging surface 71 is oriented in a plane generally along a radius of the container shoulder 52.

Although not illustrated, a pair of spaced-apart ribs or bumps could be provided on the shoulder 52 adjacent each stop member 66 and 68—one such rib on one side of the stop member 66 or 68 and the other such rib on the other side of the stop member 66 or 68.

Figure 10:
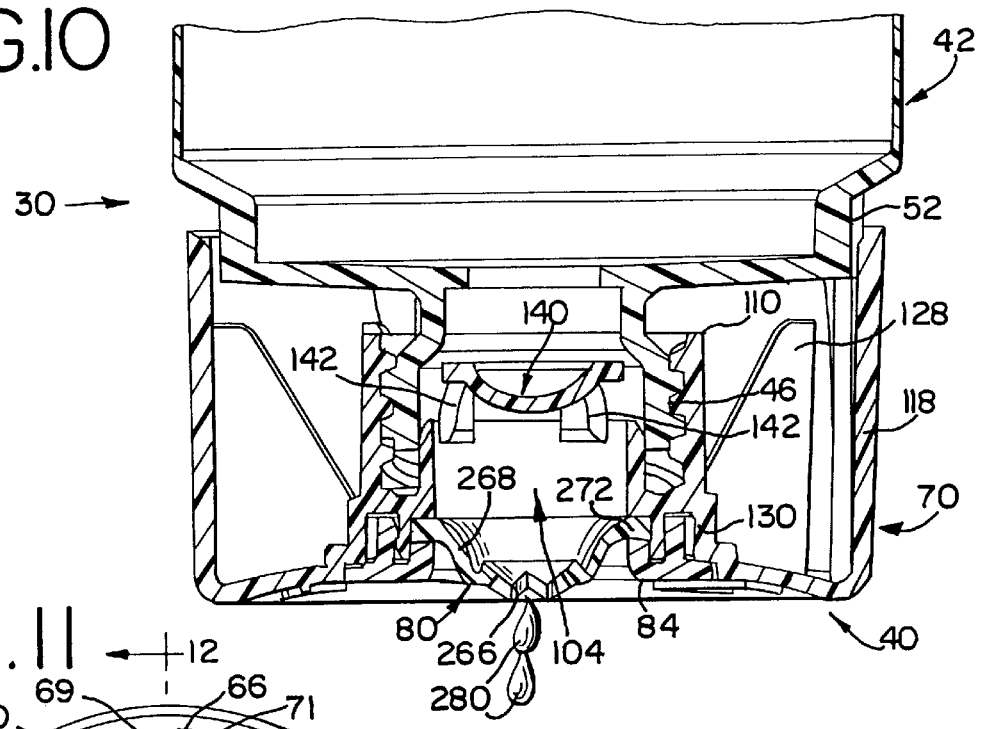
FIG. 10 is a view similar to FIG. 9, but FIG. 10 shows the container and closure in an inverted position with the container subjected to increased pressure to dispense product through the valve.

The container 42 and closure 40 may be fabricated from thermoplastic materials, or other materials, compatible with the container contents. The container 42 may be stored and used in the orientation shown in FIG. 1 wherein the closure 40 is at the top of the container 42. The container 42 may also be normally stored in an inverted position (FIG. 10). When stored in the inverted position, the container 42 employs the closure 40 as a support base.

The container 42 is a squeezable container having a flexible wall or walls which can be grasped by the user and compressed to increase the internal pressure within the container so as to squeeze the product out of the container when the closure internal shipping seal is opened (as explained in detail hereinafter). The container wall typically has sufficient, inherent resiliency so that when the squeezing forces are removed, the container wall returns to its normal, unstressed shape.

Figure 13:
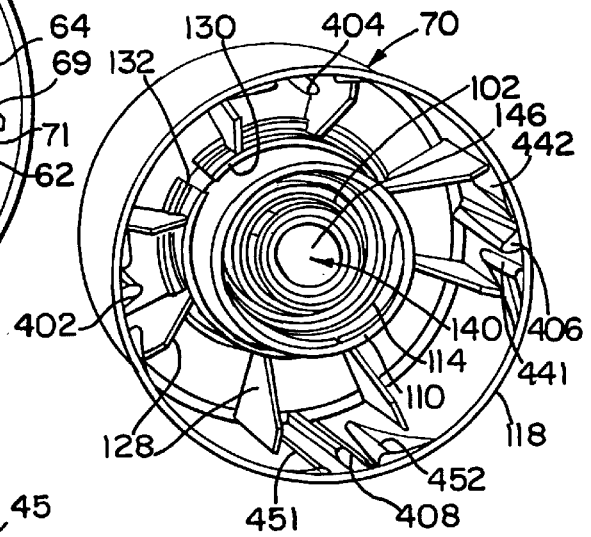
FIG. 13 is a perspective view of the underside of the closure housing (with the valve and retaining ring omitted)
Figure 14:
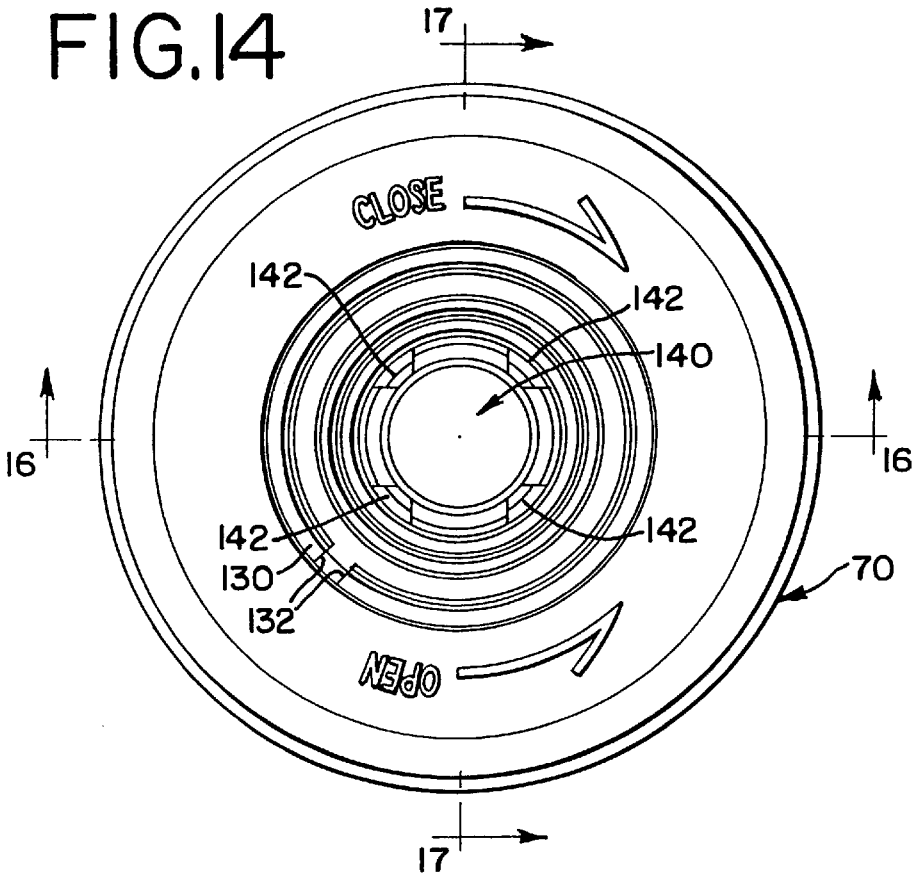
FIG. 14 is a top plan view of the closure housing shown in FIG. 13.
Figure 15:
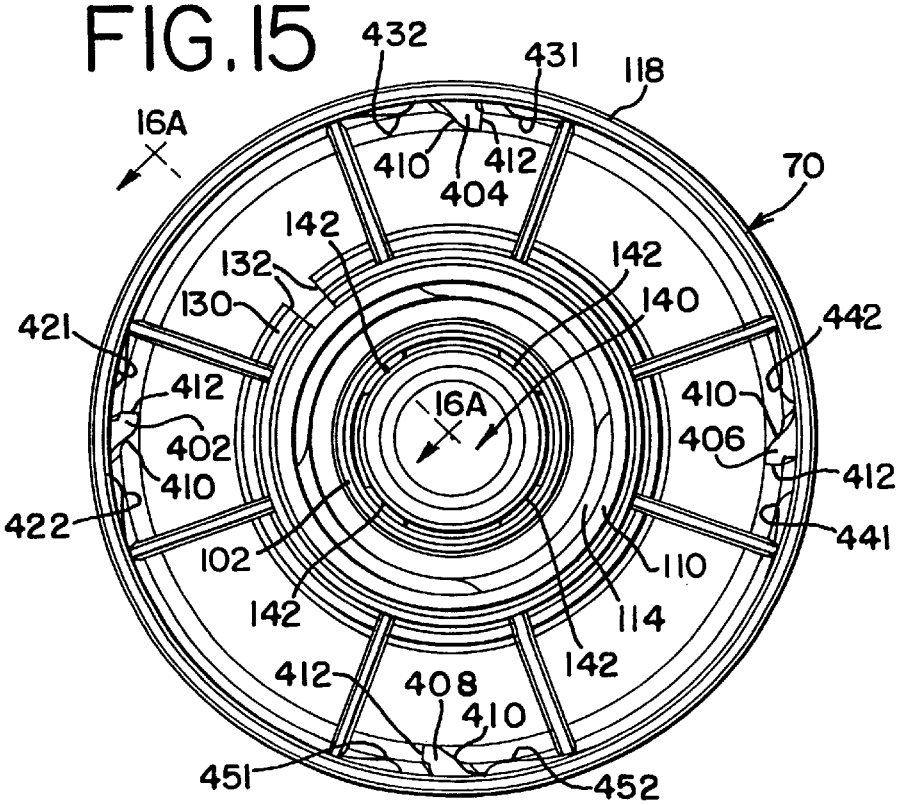
FIG. 15 is a bottom plan view of the closure housing.

As illustrated in FIGS. 1 and 2, the closure 40 includes a housing or shell 70, a valve 80, and a retaining ring 84. As shown in FIGS. 13–15, the housing 70 includes an inner wall 102 that defines a dispensing passage 104 (FIGS. 16 and 17) and that is movable with the closure 40 within the container neck 43 upwardly and downwardly as the closure 40 is moved upwardly and downwardly in a manner described in detail hereinafter.

Figure 7:
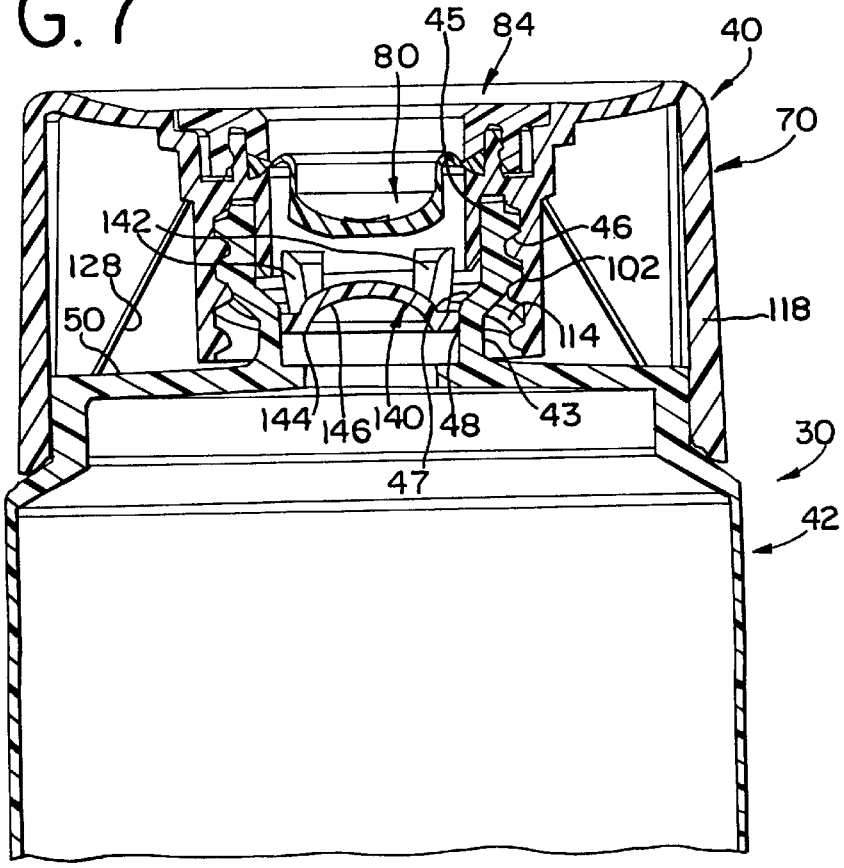
FIG. 7 is a fragmentary, cross-sectional view taken generally along the plane 7—7 in FIG. 6.

As can be seen in FIG.7, the inner wall 102 has a smooth, cylindrical, outer surface which sealingly engages the inner cylindrical surface of the container neck 43 above the inwardly tapered sealable seat 48.

Figure 9:
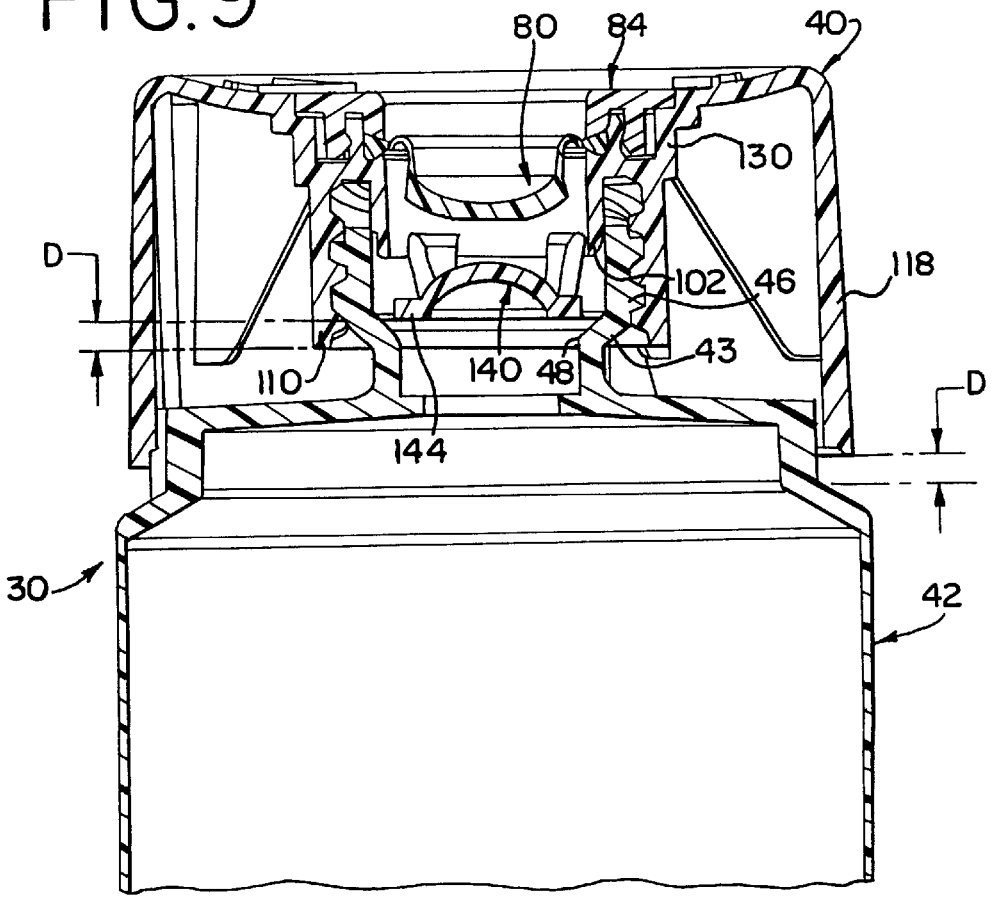
FIG. 9 is a fragmentary, cross-sectional view taken generally along the plane 9—9 in FIG. 8.

An annular seal bead 45 projects inwardly from the top, inner edge of the container neck 43 (FIGS. 7 and 12) to sealingly engage the exterior cylindrical surface of the inner annular wall 102. This establishes a dynamic plug seal. This plug seal is maintained as the closure 40 is rotated between a closed position (FIG. 7) and a fully opened position (FIG. 9).

The top of the inner wall 102 defines a frustoconical seat 106 for receiving a portion of the periphery of the valve 80 (FIG. 7) which is described in detail hereinafter.

Figure 17:
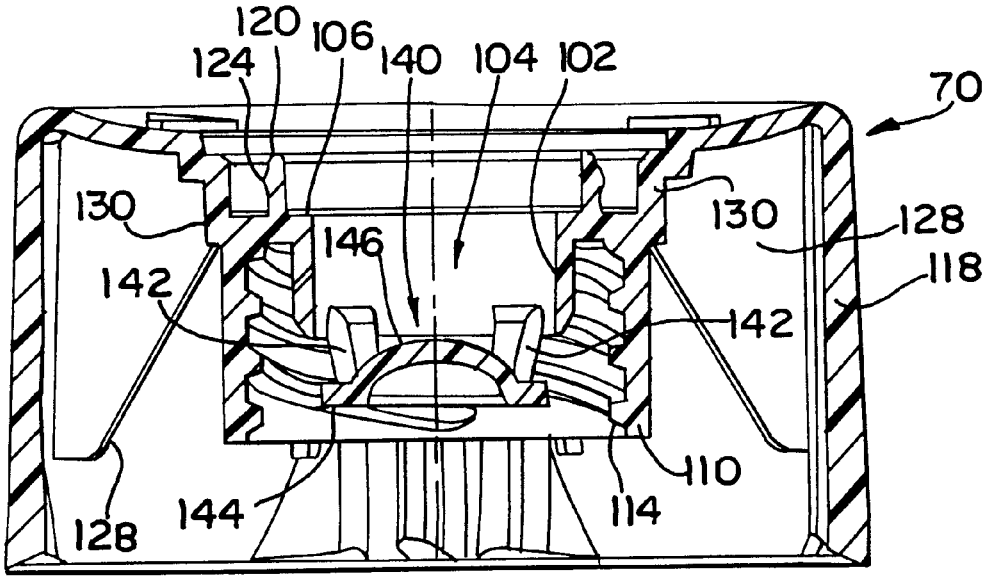
FIG. 17 is a cross-sectional view taken generally along the plane 17—17 in FIG. 14.
Figure 18:
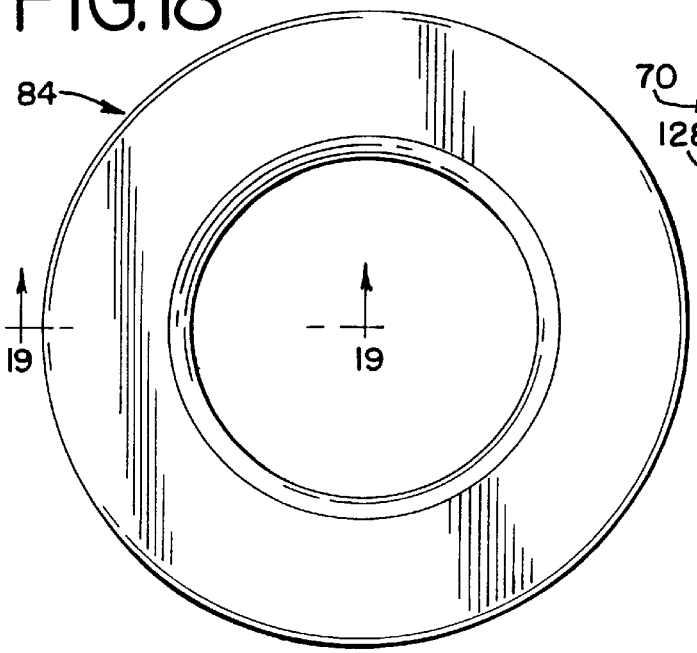
FIG. 18 is a top plan view of the valve retaining ring employed in the closure housing to hold the valve in place.
Figure 16A:
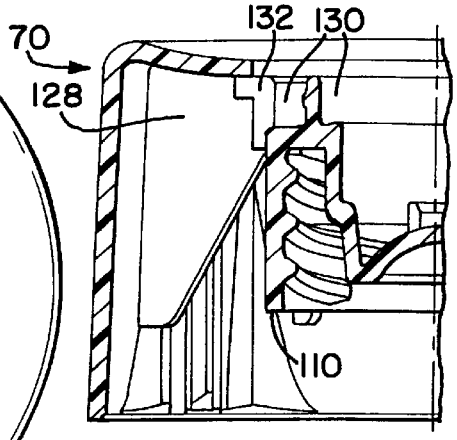
FIG. 16A is a fragmentary, cross-sectional view taken generally along the plane 16A—16A in FIG. 15.

As shown in FIG. 17, the closure housing 70 includes an intermediate annular wall 110 spaced outwardly from the inner wall 102. The intermediate annular wall 110 defines a female thread 114 for threadingly engaging the container thread 46.

The thread 46 on the container neck 43 is shown as a quad-lead helical thread form. A single helical thread form or other multi-lead thread form may be employed on the container neck 43 with a mating thread form in the closure wall 110. In an alternate embodiment (not illustrated), the female thread form could be incorporated in the container neck 43 and the male thread form could be incorporated on the closure wall 110.

An outer, annular wall 118 is spaced outwardly of the intermediate wall 110 and provides an aesthetically pleasing peripheral structure which also serves as a means by which the closure may be grasped and rotated on the container to move the closure 40 from a fully closed, lowered position (FIG. 7) to an unsealed, elevated position (FIG. 9).

The housing 70 also includes an upwardly projecting annular wall 120 (FIG. 17) with an outwardly extending peripheral bead 124 (FIG. 17). The wall 120 functions as a receiving wall adjacent the annular seat 106 for receiving and containing the valve 80. The wall 120 also functions to support the retaining ring 84 (FIG. 2) as described in detail hereinafter.

Figure 16:
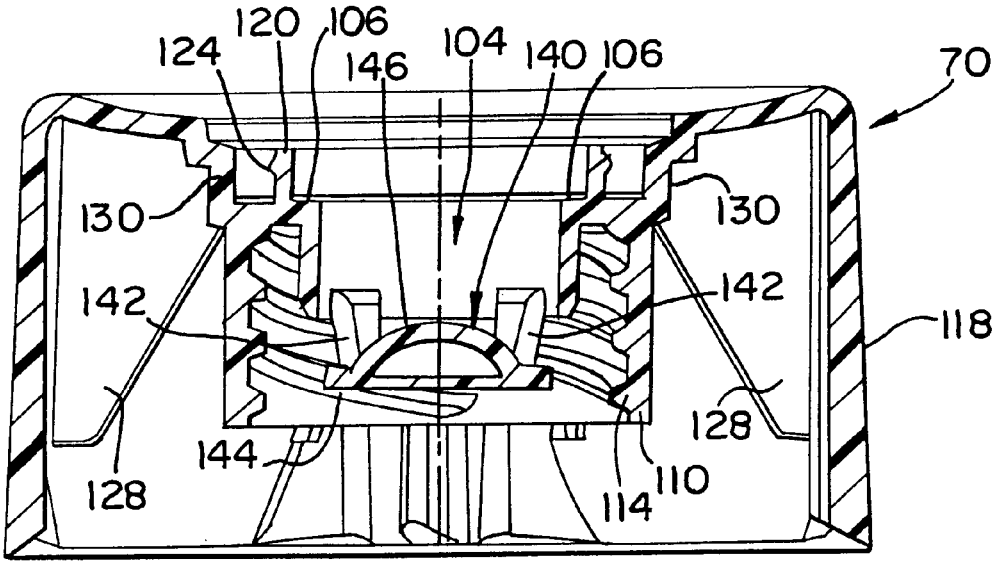
FIG. 16 is a cross-sectional view taken generally along the plane 16—16 in FIG. 14.

Between the intermediate wall 110 and the outer wall 118 are a plurality of spaced-apart, rigidifying walls or ribs 128. In the preferred embodiment, the inner end of each rigidifying rib 128 is connected to (i.e., molded as part of a unitary construction with) the upper part of the intermediate wall 110 as shown in FIGS. 16 and 17.

The upper part of the intermediate wall 110 defines a collar 130 (FIGS. 16 and 17) which has a slightly increased diameter compared to the lower portion of the intermediate wall 110. The collar 130 is adapted to receive a portion of the retaining ring 84 as illustrated in FIG. 9.

The collar 130 has a notch 132 as shown in FIGS. 13, 14, 15, and 16A. The notch 132 establishes communication between the inside of the collar 130 and the region outside of the collar 130 between the collar 130 and the outer wall 118 of the housing 70.

The slot 132 permits water to drain from the closure during one mode of use as will next be explained. Specifically, the package 30 may contain shampoo, body soap, conditioner, or a similar product. The package would then typically be used in a shower or bathroom wherein the container 42 could become wet owing to contact with the user's wet hands and/or by being splashed or sprayed with water. When the package 30 is in an inverted orientation as shown in FIG. 10 (and typically resting on a shelf or counter in a shower stall or bathroom), the water can flow down the outside of the container 42 and through a small clearance between the container shoulder 52 and the outer wall 118 of the closure housing 70. The water can accumulate in the bottom end of the closure housing 70 between the outer wall 118 and the extension collar 130 at the end of the intermediate wall 110. However, because the collar 130 has the slot 132 (FIGS. 13, 14, 15, and 16A), most of the accumulating water can flow through the slot 132 and along the outer periphery of the retaining ring 84 (FIG. 10) to the exterior of the housing 70 underneath the bottom end of the housing. There is sufficient clearance space between the outer periphery of the retaining ring 84 and the closure housing 70 to permit the water to drain out. Thus, there will only be a very small amount of water remaining in the closure housing 70 at any time when the package is in the inverted orientation (FIG. 10). Thus, when the package is subsequently turned upright (FIG. 1), no significant amount of water will flow from the closure housing 70 down the outside of the container 42.

The housing 70 includes an occlusion member 140 (FIGS. 7, 13, 14, 15, 16, and 17) which is supported below the bottom of the inner annular wall 102 by four arms 142 (FIGS. 7, 14, 15, 16, and 17). Each arm 142 projects radially inwardly and downwardly from the inside, lower end of the inner annular wall 102. The arms 142 are circumferentially spaced at 90° increments.

The occlusion member 140 has a flat, outer, annular portion 144 (FIGS. 7, 16, and 17). The occlusion member 140 includes a partially spherical, central region 146 (FIGS. 7, 16, and 17) extending upwardly from the peripheral portion 144.

The occlusion member 140 is adapted to seal off the container opening when the closure 40 is in a lowered position on the container (FIG. 7). The occlusion member 140 is adapted to permit flow out of the container opening when the closure 40 is in an elevated position (FIG. 9). Specifically, as illustrated in FIG. 7, when the closure housing 70 is threadingly engaged and rotated on the container neck 43 to the fully lowered position illustrated in FIG. 7, the peripheral surface of the occlusion member annular portion 144 engages the cylindrical wall or seat 48 to create an air-tight seal and prevent flow of liquid out of the container 42. The peripheral diameter of the annular portion 144 is just slightly greater than the internal diameter of the cylindrical wall or seat 48. This causes a slight, temporary deformation of one or both parts to effect a good seal in the closed condition. On the other hand, if the closure housing 70 is rotated in the counterclockwise direction as viewed in FIG. 6, then the entire closure 40 will move upwardly, so that the occlusion member 140 is carried away from the container neck seating surface 48 (FIG. 9). This permits the liquid to flow around the peripheral edge of the occlusion member annular portion 144.

The valve 80 is designed to be effectively clamped in position within the closure housing seat 106 (FIG. 17) by the retaining ring 84 (FIGS. 2 and 7). In the preferred form of the valve 80 illustrated, the valve 80 is of a known design employing a flexible, resilient material, which can open to dispense fluid. The valve 80 may be fabricated from thermosetting elastomeric materials such as silicone, natural rubber, and the like. It is also contemplated that the valve 80 may be fabricated from thermoplastic elastomers based upon materials such as thermoplastic propylene, ethylene, urethane, and styrene, including their halogenated counterparts.

A valve which is similar to, and functionally analogous to, valve 80 is disclosed in the U.S. Pat. No. 5,439,143. However, the valve 80 has a peripheral flange structure (described in detail hereinafter) which differs from the flange structure of the valve shown in the U.S. Pat. No. 5,439,143. The description of the valve disclosed in the U.S. Pat. No. 5,439,143 is incorporated herein by reference to the extent pertinent and to the extent not inconsistent herewith.

Figure 3:
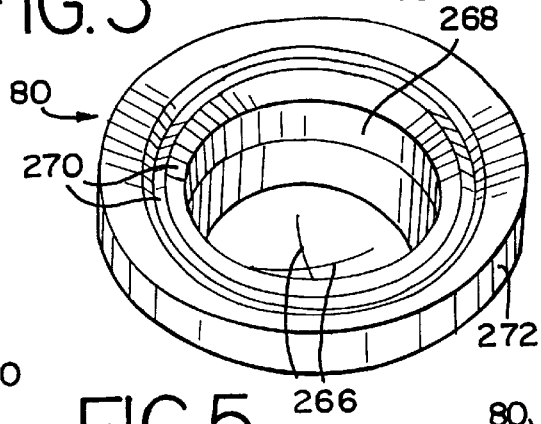
FIG. 3 is an enlarged, perspective view of the valve shown in FIG. 2.
Figure 4:
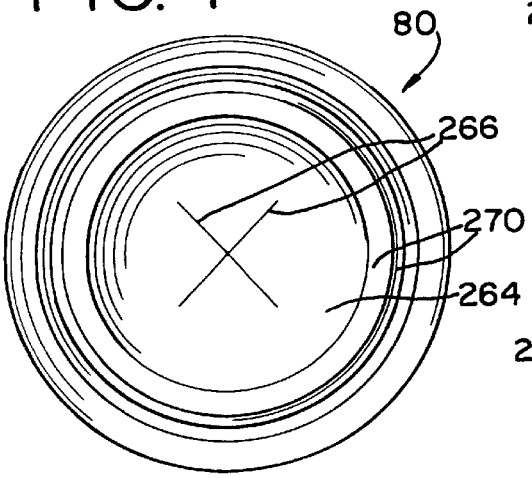
FIG. 4 is a top plan view of the valve shown in FIG. 3.
Figure 5:
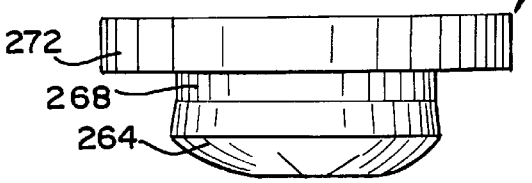
FIG. 5 is a side elevational view of the valve shown in FIGS. 3 and 4.

As illustrated in FIGS. 3–5, the valve 80 includes a flexible, central portion, wall, or face 264 which has a concave configuration (when viewed from the exterior) and which defines two, mutually perpendicular, intersecting dispensing slits 266 of equal length. The intersecting slits 266 define four, generally sector-shaped, flaps or petals in the concave, central wall 64. The flaps open outwardly from the intersection point of the slits 266, in response to increasing container pressure of sufficient magnitude, in the well-known manner described in the U.S. Pat. No. 5,439,143.

The valve 80 includes a skirt 268 (FIG. 5) which extends outwardly from the valve central wall or face 264. At the outer (upper) end of the skirt 268 there is a thin, annular flange 270 which extends peripherally from the skirt 268 in an angled orientation. The thin flange 270 terminates in an enlarged, much thicker, peripheral flange 272 which has a generally dovetail shaped transverse cross section.

To accommodate the seating of the valve 80 in the closure housing 70, the attachment region or seat 106 of the closure housing 70 has the same angle as the angle of the valve flange dovetail configuration. The bottom surface of the valve flange 272 is disposed on the closure housing valve seat 106.

Figure 19:
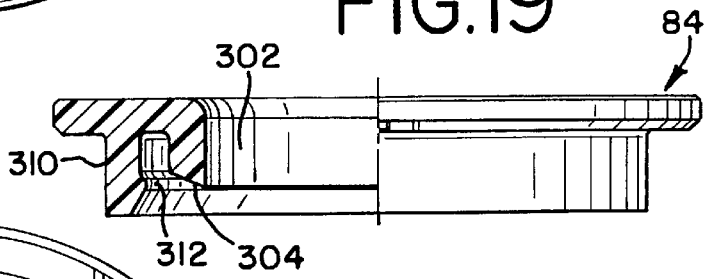
FIG. 19 is a side elevational view of the retaining ring partially in cross section as taken along the plane 19—19 in FIG. 18.
Figure 20:
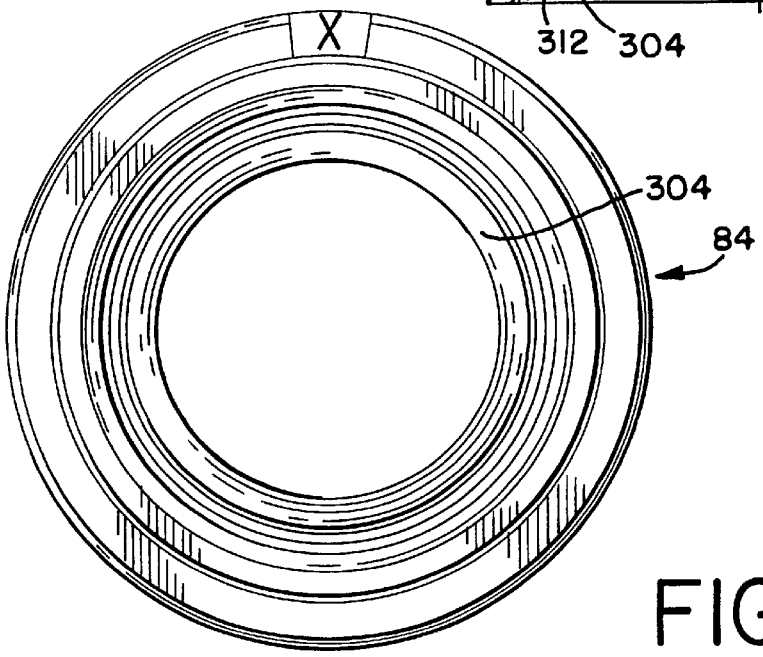
FIG. 20 is a bottom plan view of the retaining ring.
Figure 21:
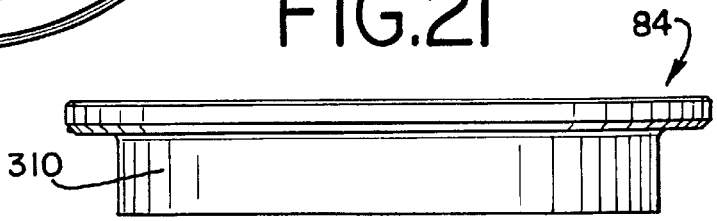
FIG. 21 is a full side elevational view of the retaining ring.

The upper surface of the valve flange 272 is clamped by the retaining ring 84. As illustrated in FIG. 19, the retaining ring 84 includes an inner, annular clamping wall 302 having a downwardly angled bottom and clamping surface 304. When the retaining ring 84 is mounted on the closure housing 70, the spacing between the clamping surface 304 of the retaining ring 84 and the closure housing valve seat 106 (FIGS. 15 and 17) increases with increasing radial distance from the center of the valve 80. Such a configuration defines an annular cavity with a transverse cross section having a dove-tail shape which generally conforms to the dove-tail shape of the valve flange 272.

The retaining ring 80 includes an outer annular wall 310 (FIG. 19) with a radially inwardly extending bead 312. When the retaining ring 84 is preferably mounted in the closure housing 70 (FIG. 7), the retaining bead 312 (FIG. 19) is adapted to be received under the bead 124 of the housing annular wall 120 (FIG. 16) in a snap-fit engagement. This arrangement securely clamps and holds the valve 80 without requiring special internal support structures or bearing members adjacent the interior surface of the valve cylindrical skirt 268. This permits the region adjacent the interior surface of the valve cylindrical skirt 268 to be substantially open, free, and clear so as to accommodate movement of the valve skirt 268.

If desired, the valve 80 could be retained in the closure housing 70 without the retaining ring 84. For example, the valve 80 could be bonded to the closure housing 70 with adhesive or could be directly molded onto the closure housing 70 so as to create a weld defined by interface solidification of melted portions of the materials. The valve 80 could be molded with the slits 266. Alternatively, the valve slits 266 could be subsequently cut into the wall or face 264 of the valve 80 by suitable conventional techniques.

When the valve 80 is properly mounted within the closure housing 70 as illustrated in FIG. 7, the central wall or face 264 of the valve 80 lies recessed within the closure housing. However, when the container 42 is squeezed to dispense the contents through the valve 80 (as described in detail in the U.S. Pat. No. 5,439,143), then the valve central wall or face 264 is forced outwardly from its recessed position toward the end of the housing 70.

In order to dispense product from the container 42, the occlusion member 140 is opened by rotating the closure housing 70 on the container 42 to the elevated position (FIG. 9). In use, the container 42 is then typically inverted and squeezed to increase the pressure within the container 42 above the ambient exterior atmospheric pressure. This forces the product within the container toward the valve 80 and forces the valve 80 from the recessed or retracted position (illustrated in FIGS. 7 and 9) toward the outwardly extending position (FIG. 10). The outward displacement of the central face 264 of the valve 80 is accommodated by the relatively, thin, flexible, skirt 268. The skirt 268 moves from an inwardly projecting, rest position to an outwardly displaced, pressurized position, and this occurs by the skirt 268 "rolling" along itself outwardly toward the outside of the housing 70 (toward the position shown in FIG. 10). However, the valve 80 does not open (i.e., the slits 266 do not open) until the valve central face 264 has moved substantially all the way to a fully extended position beyond the dispensing passage 104. Indeed, as the valve central wall 264 begins to move outwardly, the valve central wall 264 is initially subjected to radially inwardly directed compression forces which tend to further resist opening of the slits 266. Also, the valve central wall 264 generally retains its inwardly concave configuration as it moves outwardly and even after it reaches the fully extended position. However, when the internal pressure becomes sufficiently high after the valve central wall 264 has moved outwardly to the fully extended position, then the slits 266 of the valve 80 begin to open to dispense product (FIG. 10). The product is then expelled or discharged through the open slits 266. For illustrative purposes, FIG. 10 shows drops 280 of a liquid product being discharged.

When the contents of the container 42 are dispensed through the dispensing passage 104, the contents flow past the open occlusion member 140, between the arms 142, and into the region below the valve 80 in the dispensing passage 104. The container contents can then be dispensed through the valve 80 if the valve is forced open by sufficient internal pressure generated by squeezing the container in the known manner (as described in detail in U.S. Pat. No. 5,429,143).

When the closure 40 is manufactured and initially assembled on the container 42, the closure 40 is typically initially arranged in the lowered, closed condition (FIG. 7). This is also the condition in which the container 42 can be conveniently carried in a user's suitcase while the user is travelling. In the closed condition, any increased pressure in the container will be prevented from acting on the valve 80 because of the occlusion of the container opening 41 (FIG. 12) by the closed occlusion member 140 (FIG. 7).

The closure housing 70 includes abutment features which cooperate with the container stop members 54, 60, 66, and 68. Specifically, the closure housing 70 includes one or more stop members, such as stop lugs or stop members 402, 404, 406, and 408 (FIGS. 13 and 15). Each stop member projects radially inwardly from the housing outer wall 118. Each stop member 402, 404, 406, and 408 has a rear, angled and curved surface 410 (FIG. 15), and each stop member 402, 404, 406, and 408 has a front engaging face 412 (FIG. 15) which is generally oriented on a plane along a radius of the closure 40.

In the preferred embodiment illustrated, there are four stop members 402, 404, 406, and 408. However, it is contemplated that alternate designs might include more than, or less than, four stop members, even only one stop member. Further, according to another aspect of the invention, the stop members on the closure housing 70, as well as on the container shoulder 52, may be omitted altogether. However, the stop members provide an operational advantage, and it is presently contemplated that the preferred arrangement includes at least two stop members on the container shoulder (e.g., either stop members 54 and 60, or stop members 66 and 68) and at least two stop members on the closure housing (e.g., either stop members 402 and 410, or stop members 404 and 408).

In the presently preferred embodiment, ribs or bumps are provided adjacent each closure housing stop member 402, 404, 406, and 408. In particular, ribs or bumps 421 and 422 are adjacent the stop member 402, one rib on one side of the stop member 402, and the other rib on the other side of the stop member 402. A similar arrangement is provided around the stop member 404 which is disposed between the ribs 431 and 432. Ribs 441 and 442 are provided around the stop member 406, and ribs 451 and 452 are provided around the stop member 408.

During assembly of the package 30, the closure 40 can be threaded onto the container 42 because the shapes of the stop members on the container shoulder 52 and the shapes of the stop members on the closure housing 70 accommodate such assembly. In particular, as the closure 40 is rotated into complete engagement with the threads of the container 42, the angled and curved rear surfaces 410 of each of the closure housing stop members 402, 404, 408, and 410 engage, and slide over and past, the angled engaging surfaces 69 of the container stop members 54, 60, 64, and 68. The closure housing 70 is sufficiently flexible to accommodate slight outward deformation as may be required to accommodate the movement of the stop members past each other.

A system is provided for establishing the maximum axial displacement between the container 42 and the closure 40. When the closure 40 is threadingly engaged completely onto the container 42 as shown in FIG. 7, the periphery of the occlusion member 140 sealingly engages the inner surface of the container neck 43, and the axial movements of the closure 40 and container 42 toward each other are limited by the engagement between the bottom end of the closure outer wall 118 and the container 42 (FIG. 7), and by the engagement between the rear surfaces 410 of the closure stop members 402, 404, 406, and 408 (FIGS. 7 and 15) and the rear surfaces 69 of the container neck stop members 54, 60, 66, and 68. Also, the bottom end of each closure rigidifying wall 128 engages the container upper end wall 50 (FIG. 7).

Figure 6:
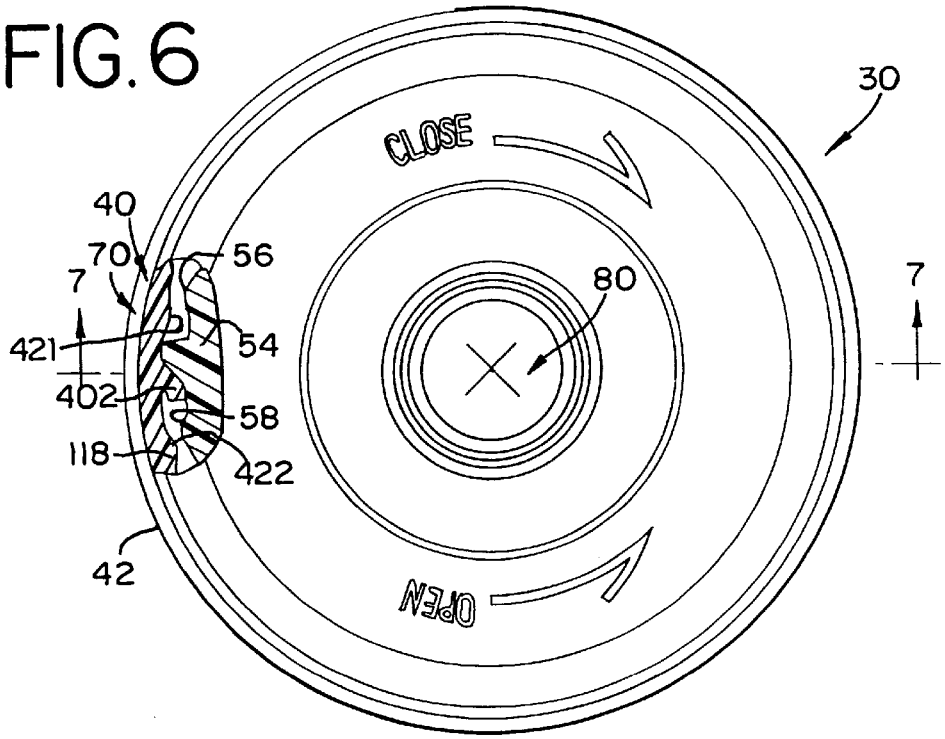
FIG. 6 is a top plan view of the dispensing system closure with the closure shown in the lowered, closed position on the container and with portions broken away to illustrate interior details.

When the closure 40 is fully threadingly engaged on the container 42 (FIGS. 6 and 7), the rear, angled and curved surfaces of the closure housing stop members 402, 404, 406, and 408 are adjacent, or possibly in contact with, the rear, angled surfaces of the container stop members 54, 60, 66, 68. In FIG. 6, the container stop member 54 is shown adjacent the closure housing stop member 402. It will be appreciated, with reference to FIG. 6, that the container stop member 54 lies between the closure stop member 402 and the closure rib 421. Similarly, the closure stop member 402 lies between the container stop member 54 and the container rib 58. The rib 421 and the rib 58 each define a projecting bump which provides some resistance to relative movement between the closure 40 and container 42 away from the fully closed position illustrated in FIG. 6. Specifically, if the user attempts to open the closure 40 by rotating the closure 40 in the counterclockwise direction as viewed in FIG. 6, then the closure rib 421 will engage the distal end of the container stop member 54. Similarly, the distal end of the closure stop member 402 will engage the container rib 58. This will provide a resistance that must be overcome to begin opening the dispensing system. This arrangement also serves to prevent unintentional opening of the package such as might occur if the package is picked up by the user or perhaps jostled during shipping, packing, and handling.

When sufficient relative torque is applied between the closure 40 on the one hand and the container 42 on the other hand to open the dispensing system, the stop lugs 402 and 54 will deflect sufficiently and/or the closure housing outer wall 118 will deflect outwardly sufficiently, to permit the closure rib 421 to move past the container stop member 54 and to permit the closure stop member 402 to move past the container rib 58.

Figure 8:
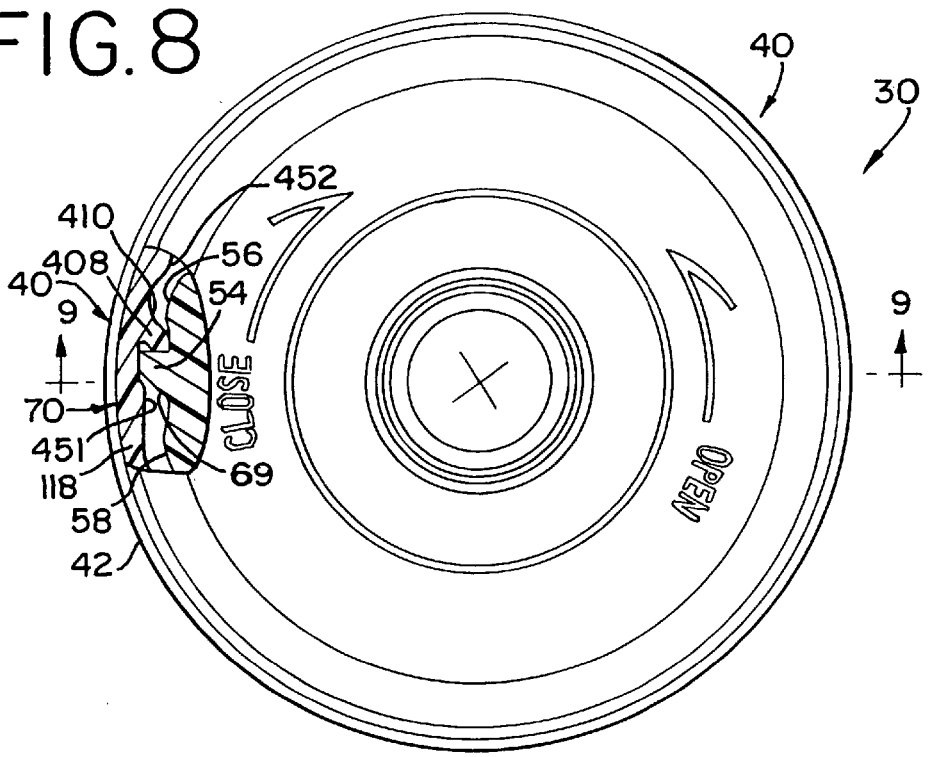
FIG. 8 is a top plan view similar to FIG. 6, but FIG. 8 shows the closure rotated nearly 90° to an open, elevated, unsealed orientation.

FIG. 8 shows the system components rotated about 90° from the closed position to the open position wherein the occlusion member 140 is spaced outwardly beyond the container seat 48 (FIG. 9). FIG. 9 shows that the closure has been elevated a distance D above the shoulder of the container 30. As shown in FIG. 8, the engaging face of the closure housing stop member 408 engages the engaging face of the container stop member 54. This engagement terminates the rotation of the closure relative to the container 42 and limits the upward movement of the closure 40 (and hence, limits the upward movement of the occlusion member 140). The container rib 56 and closure housing rib 451 provide some resistance to rotation of the closure 40 away from the fully opened position (clockwise as viewed in FIG. 8). If the user attempts to rotate the closure 40 to close the system, by rotating the closure 40 in the clockwise direction as viewed in FIG. 8, the rear, angled surface 410 of the closure stop member 408 will engage the container rib 56, and the rear, angled surface 69 of the container stop member 54 will engage the closure rib 451. Sufficient torque must be exerted to cause slight deformation of the stop members and/or outward expansion of the closure housing 70 to permit rotation of the closure 40 in the clockwise direction away from the fully opened position toward the closed position. The resistance to movement away from the fully opened position (which is afforded by the ribs 56 and 451 acting against the stop members 408 and 54, respectively) is also effective to inhibit unintentional closing of the system when the already open package 30 is picked up by a user.

With reference to FIG. 8, the engagement relationship between the closure stop member 408 and the container stop member 54 occurs in an analogous fashion with respect to the other three sets of stop members which are not visible under the closure top surface in FIG. 8.

It will be appreciated that the stop member arrangement and rib arrangement may be omitted in some applications if precise locations of the fully open condition and fully closed condition of the package 30 are not required. Further, in some applications, it may be desirable to provide only the stop members on the container 42 and on the closure 40, but not the cooperating ribs on either or both the container 42 or closure 40. Further, in some applications, it may be desirable to provide only one or two stop members on the container closure and only one or two stop members on the container.

It will be appreciated that the preferred embodiment of the dispensing structure of the present invention provides a system for covering an opening to a container with a self-closing valve. Further, the system includes components which are movable between (1) a closed position wherein the valve is sealed from the container, and (2) an open position wherein the valve is in communication with the container to accommodate dispensing of the container contents.

It will also be appreciated that the dispensing system of the present invention may be provided with a variety of dispensing passage structures. Although the illustrated embodiment employs a closure housing with a flexible, slit-type, dispensing valve in the dispensing passage, other types of valves may be employed.

If desired, a releasable, pull-away label or tab (not illustrated) could be sealed to the closure top (e.g., the retaining ring 84) over the recessed valve 80 to protect the valve and prevent contaminants from contacting the valve 80 during shipping, storage, and handling.

The preferred form of the system of the present invention is aesthetically pleasing and has no lid which could interfere with the dispensing of the product from the container. Additionally, because there is no lid, the user's view of the dispensing process is not obscured.

It will be readily observed from the foregoing detailed description of the invention and from the illustrations thereof that numerous other variations and modifications may be effected without departing from the true spirit and scope of the novel concepts or principles of this invention.

What is claimed is:

1. A dispensing system comprising:

a container having an opening, a sealable seat around said opening, and a thread; and a closure which (1) is disposed on said container, (2) defines a thread that is threadingly engaged with said container thread for accommodating movement of said closure between a lowered position and an elevated position, (3) defines a dispensing passage for establishing communication between said container opening and the exterior of said closure, (4) includes a dispensing valve disposed in said dispensing passage for opening to dispense fluid therethrough and for closing to occlude flow, and (5) includes an occlusion member inwardly of said valve in said dispensing passage, said occlusion member being part of, and movable with, said closure between said lowered and elevated positions to sealingly engage said container sealable seat and prevent flow from said container opening into said dispensing passage below said valve when said closure is in said lowered position and to permit flow into said dispensing passage when said closure is in said elevated position.

2. The system in accordance with claim 1 in which each said thread is a helical thread.

3. The system in accordance with claim 1 in which said container thread is a male thread and said housing thread is a female thread.

4. The system in accordance with claim 1 in which said closure comprises (1) a housing, (2) said valve, and (3) a valve retaining ring clamping said valve against said housing.

5. The system in accordance with claim 1 in which said container defines a pair of spaced-apart ribs and said closure includes an inwardly projecting stop member for engaging one of said ribs of said container to provide increased resistance to relative rotation between said container and said closure.

6. A dispensing system comprising:

a container having an opening, a sealable seat around said opening, and a thread; and a closure which (1) is disposed on said container, (2) defines a thread that is threadingly engaged with said container thread for accommodating movement of said closure between a lowered position and an elevated position, (3) defines a dispensing passage for establishing communication between said container opening and the exterior of said closure, (4) includes a dispensing valve disposed in said dispensing passage for opening to dispense fluid therethrough and for closing to occlude flow, and (5) includes an occlusion member inwardly of said valve in said dispensing passage to sealingly engage said container sealable seat and prevent flow from said container opening into said dispensing passage below said valve when said closure is in said lowered position and to permit flow into said dispensing passage when said closure is in said elevated position and wherein said container has a neck around said opening;

said container thread is defined on the exterior of said neck;

said sealable seat is defined as a cylindrical surface on the interior of said neck;

said closure includes an inner annular wall that is adapted to be received within said container neck;

said closure includes an intermediate annular wall that is spaced outwardly of said inner annular wall and that defines said closure thread;

said closure includes an outer wall spaced outwardly of said intermediate annular wall;

said closure includes an inner annular wall that defines said dispensing passage and that is movable within said container neck toward and away from said container; and said closure occlusion member is a disk-like member that is supported by arms extending inwardly from said inner annular wall and that defines a peripheral sealing surface for engaging said container neck cylindrical surface around said container opening when said closure is in said lowered position.

7. A dispensing system comprising:

a container having an opening, a sealable seat around said opening, and a thread; and a closure which (1) is disposed on said container, (2) defines a thread that is threadingly engaged with said container thread for accommodating movement of said closure between a lowered position and an elevated position, (3) defines a dispensing passage for establishing communication between said container opening and the exterior of said closure, (4) includes a dispensing valve disposed in said dispensing passage for opening to dispense fluid therethrough and for closing to occlude flow, and (5) includes an occlusion member inwardly of said valve in said dispensing passage to sealingly engage said container sealable seat and prevent flow from said container opening into said dispensing passage below said valve when said closure is in said lowered position and to permit flow into said dispensing passage when said closure is in said elevated position and wherein said container has at least one outwardly projecting stop member; and said closure has at least one inwardly projecting stop member for engaging said outwardly projecting stop member at one of said lowered position and elevated position.

8. A dispensing system comprising:

a container having an opening, a sealable seat around said opening, and a thread; and a closure which (1) is disposed on said container, (2) defines a thread that is threadingly engaged with said container thread for accommodating movement of said closure between a lowered position and an elevated position, (3) defines a dispensing passage for establishing communication between said container opening and the exterior of said closure, (4) includes a dispensing valve disposed in said dispensing passage for opening to dispense fluid therethrough and for closing to occlude flow, and (5) includes an occlusion member inwardly of said valve in said dispensing passage to sealingly engage said container sealable seat and prevent flow from said container opening into said dispensing passage below said valve when said closure is in said lowered position and to permit flow into said dispensing passage when said closure is in said elevated position and wherein said closure defines at least one pair of spaced-apart ribs; and said container includes an outwardly projecting stop member for engaging one of said ribs of said closure to provide increased resistance to relative rotation between said container and said closure.

9. A dispensing system comprising:

a container having an opening, a sealable seat around said opening, and a thread; and a closure which (1) is disposed on said container, (2) defines a thread that is threadingly engaged with said container thread for accommodating movement of said closure between a lowered position and an elevated position, (3) defines a dispensing passage for establishing communication between said container opening and the exterior of said closure, (4) includes a dispensing valve disposed in said dispensing passage for opening to dispense fluid therethrough and for closing to occlude flow, and (5) includes an occlusion member inwardly of said valve in said dispensing passage to sealingly engage said container sealable seat and prevent flow from said container opening into said dispensing passage below said valve when said closure is in said lowered position and to permit flow into said dispensing passage when said closure is in said elevated position and wherein said container defines a pair of spaced-apart container ribs;

said closure has a pair of spaced-apart closure ribs; and said container and closure each includes a projecting stop member for engaging one of said ribs on said closure and container, respectively, to provide increased resistance to relative rotation between said container and said closure.

10. A dispensing system comprising:

a container having an opening, a sealable seat around said opening, and a thread; and a closure which (1) is disposed on said container, (2) defines a thread that is threadingly engaged with said container thread for accommodating movement of said closure between a lowered position and an elevated position, (3) defines a dispensing passage for establishing communication between said container opening and the exterior of said closure, (4) includes a dispensing valve disposed in said dispensing passage for opening to dispense fluid therethrough and for closing to occlude flow, and (5) includes an occlusion member inwardly of said valve in said dispensing passage to sealingly engage said container sealable seat and prevent flow from said container opening into said dispensing passage below said valve when said closure is in said lowered position and to permit flow into said dispensing passage when said closure is in said elevated position and wherein said container has a pair of ribs and one outwardly projecting stop member between said ribs; and said closure has at least one inwardly projecting stop member for (1) engaging said container stop member when said closure is at one of said lowered position and elevated position to prevent further rotation in a first direction, and (2) engaging one of said ribs to provide increased resistance to relative rotation between said container and said closure in a second direction of rotation opposite to said first direction of rotation.

11. A dispensing system comprising:

a container having an opening, a sealable seat around said opening, and a thread; and a closure which (1) is disposed on said container, (2) defines a thread that is threadingly engaged with said container thread for accommodating movement of said closure between a lowered position and an elevated position, (3) defines a dispensing passage for establishing communication between said container opening and the exterior of said closure, (4) includes a dispensing valve disposed in said dispensing passage for opening to dispense fluid therethrough and for closing to occlude flow, and (5) includes an occlusion member inwardly of said valve in said dispensing passage to sealingly engage said container sealable seat and prevent flow from said container opening into said dispensing passage below said valve when said closure is in said lowered position and to permit flow into said dispensing passage when said closure is in said elevated position and wherein said closure has a pair of ribs and one inwardly projecting stop member between said ribs; and said container has at least one outwardly projecting stop member for (1) engaging said closure stop member when said closure is at one of said lowered position and elevated position to prevent further rotation in a first direction, and (2) engaging one of said ribs to provide increased resistance to relative rotation between said container and said closure in a second direction of rotation opposite to said first direction of rotation.

12. A dispensing system comprising:

a container having an opening, a sealable seat around said opening, a thread, and at least one outwardly projecting stop member; and a closure which (1) is disposed on said container, (2) defines a thread that is threadingly engaged with said container thread for accommodating movement of said closure between a lowered position and an elevated position, (3) includes at least one inwardly projecting stop member for engaging said outwardly projecting stop member when said closure is at said elevated position, (4) defines a dispensing passage for establishing communication between said container opening and the exterior of said closure, (5) includes a dispensing valve disposed in said dispensing passage for opening to dispense fluid therethrough and for closing to occlude flow, and (6) includes an occlusion member inwardly of said valve in said dispensing passage, said occlusion member being part of, and movable with, said closure between said lowered and elevated positions to sealingly engage said container sealable seat and prevent flow from said container opening into said dispensing passage below said valve when said closure is in said lowered position and to permit flow into said dispensing passage when said closure is in said elevated position.

13. The system in accordance with claim 12 in which each said thread is a helical thread.

14. The system in accordance with claim 12 in which said container defines a rib for being engaged by said closure inwardly projecting stop member to provide increased resistance to relative rotation between said container and said closure in the direction of rotation which causes said closure to move away from said elevated position toward said lowered position.

15. A dispensing system comprising:

a container having an opening, a sealable seat around said opening, a thread, and at least one outwardly projecting stop member; and a closure which (1) is disposed on said container, (2) defines a thread that is threadingly engaged with said container thread for accommodating movement of said closure between a lowered position and an elevated position, (3) includes at least one inwardly projecting stop member for engaging said outwardly projecting stop member when said closure is at said elevated position, (4) defines a dispensing passage for establishing communication between said container opening and the exterior of said closure, (5) includes a dispensing valve disposed in said dispensing passage for opening to dispense fluid therethrough and for closing to occlude flow, and (6) includes an occlusion member inwardly of said valve in said dispensing passage to sealingly engage said container sealable seat and prevent flow from said container opening into said dispensing passage below said valve when said closure is in said lowered position and to permit flow into said dispensing passage when said closure is in said elevated position and wherein said container thread is a male thread and said closure thread is a female thread.

16. A dispensing system comprising:

a container having opening, a sealable seat around said opening, a thread, and at least one outwardly projecting stop member; and a closure which (1) is disposed on said container, (2) defines a thread that is threadingly engaged with said container thread for accommodating movement of said closure between a lowered position and an elevated position, (3) includes at least one inwardly projecting stop member for engaging said outwardly projecting stop member when said closure is at said elevated position, (4) defines a dispensing passage for establishing communication between said container opening and the exterior of said closure, (5) includes a dispensing valve disposed in said dispensing passage for opening to dispense fluid therethrough and for closing to occlude flow, and (6) includes an occlusion member inwardly of said valve in said dispensing passage to sealingly engage said container sealable seat and prevent flow from said container opening into said dispensing passage below said valve when said closure is in said lowered position and to permit flow into said dispensing passage when said closure is in said elevated position and wherein said closure comprises (1) a housing, (2) said valve, and (3) a valve retaining ring clamping said valve against said housing.

17. A dispensing system comprising:

a container having an opening, a sealable seat around said opening, a thread, and at least one outwardly projecting stop member; and a closure which (1) is disposed on said container, (2) defines a thread that is threadingly engaged with said container thread for accommodating movement of said closure between a lowered position and an elevated position, (3) includes at least one inwardly projecting stop member for engaging said outwardly projecting stop member when said closure is at said elevated position, (4) defines a dispensing passage for establishing communication between said container opening and the exterior of said closure, (5) includes a dispensing valve disposed in said dispensing passage for opening to dispense fluid therethrough and for closing to occlude flow, and (6) includes an occlusion member inwardly of said valve in said dispensing passage to sealingly engage said container sealable seat and prevent flow from said container opening into said dispensing passage below said valve when said closure is in said lowered position and to permit flow into said dispensing passage when said closure is in said elevated position and wherein said container has a neck around said opening;

said container thread is defined on the exterior of said neck;

said sealable seat is defined as a cylindrical surface on the interior of said neck;

said closure includes an inner annular wall that is adapted to be received within said container neck;

said closure includes an intermediate annular wall that is spaced outwardly of said inner annular wall and that defines said closure thread;

said closure includes an outer wall spaced outwardly of said intermediate annular wall;

said closure includes an inner annular wall that defines said dispensing passage and that is movable within said container neck toward and away from said container; and said closure occlusion member is a disk-like member that is supported by arms extending inwardly from said inner annular wall and that defines a peripheral sealing surface for engaging said container neck cylindrical surface around said container opening when said closure is in said lowered position.

18. A dispensing system comprising:

a container having an opening, a sealable seat around said opening, a thread, and at least one outwardly projecting stop member; and a closure which (1) is disposed on said container, (2) defines a thread that is threadingly engaged with said container thread for accommodating movement of said closure between a lowered position and an elevated position, (3) includes at least one inwardly projecting stop member for engaging said outwardly projecting stop member when said closure is at said elevated position, (4) defines a dispensing passage for establishing communication between said container opening and the exterior of said closure, (5) includes a dispensing valve disposed in said dispensing passage for opening to dispense fluid therethrough and for closing to occlude flow, and (6) includes an occlusion member inwardly of said valve in said dispensing passage to sealingly engage said container sealable seat and prevent flow from said container opening into said dispensing passage below said valve when said closure is in said lowered position and to permit flow into said dispensing passage when said closure is in said elevated position and wherein said container has a pair of container ribs, and said outwardly projecting stop member is located between said container ribs; and said closure has a pair of closure ribs, and said inwardly projecting stop member is located between said closure ribs.

* * * * *